US005542199A

United States Patent [19]

Dreisbach et al.

[11] Patent Number: 5,542,199

[45] Date of Patent: Aug. 6, 1996

[54] GARMENT PRESSING APPARATUS WITH GARMENT END ROTATOR

[75] Inventors: Mark S. Dreisbach, Lopez; Russell J. Miller, Milan; John Dehler, New Albany, all of Pa.

[73] Assignee: Hoffman/New Yorker, Inc., Dushore, Pa.

[21] Appl. No.: 504,759

[22] Filed: Jul. 19, 1995

[51] Int. Cl.[6] ..... D06F 71/29; D06F 71/40

[52] U.S. Cl. ..... 38/12

[58] Field of Search ..... 38/1 R, 2, 12, 38/13, 14, 18, 22, 64, 40, 108, 111; 223/52, 57, 63, 70, 72, 73

[56] References Cited

U.S. PATENT DOCUMENTS

| | | | |
|---|---|---|---|
| 1,766,187 | 6/1930 | Pauly | 38/12 |
| 1,826,971 | 10/1931 | Widness | 38/70 |
| 2,295,112 | 9/1942 | Hurley, Jr. | 38/64 X |
| 2,556,049 | 6/1951 | Stout | 223/39 |
| 2,923,076 | 2/1960 | Linton | 38/12 |
| 2,931,546 | 4/1960 | Brunier | 223/73 |
| 3,173,820 | 3/1965 | Adler | 223/2 |
| 3,174,662 | 3/1965 | Kannegiesser et al. | 223/57 |
| 3,366,292 | 1/1968 | Thompson | 223/73 |
| 3,463,367 | 8/1969 | Campbell et al. | 223/57 |
| 3,749,292 | 7/1973 | Engelbart | 223/57 |
| 3,823,854 | 7/1974 | Everett | 223/73 |
| 3,865,285 | 2/1975 | McCormack et al. | 223/73 |
| 4,223,816 | 9/1980 | Glover | 223/37 |
| 4,351,457 | 9/1982 | Engelbart | 223/57 |
| 4,371,102 | 2/1983 | Engelbart | 223/73 |
| 4,689,905 | 9/1987 | Vartan | 38/26 |
| 4,807,376 | 2/1989 | Kamata | 38/42 |
| 5,054,218 | 10/1991 | Mai | 38/1 B |

*Primary Examiner*—Ismael Izaguirre
*Attorney, Agent, or Firm*—Nies, Kurz, Bergert & Tamburro

[57] ABSTRACT

Pants pressing apparatus including a buck around which an operator turns the top or waist end of a pair of pants and cycles a pressing head with respect to the buck to perform the top end pressing operation. The apparatus includes a rotator mechanism including a clamp assembly which grasps the bottom end or cuffs of the pants and turns the cuffs and legs of the pants incrementally through 360° as the operator is topping the waist end of the pants. The finished pants are thus free of any undesirable wrinkles.

19 Claims, 3 Drawing Sheets

54
56
84
50
52
66
64
70
62
72
68
58
26
57
24
4
4

54
56
52
84
68
60
57
26
50
24

14
62
50
52
82
A
32
40
42
90
94
92
74
60
12
34
36
46

GARMENT PRESSING APPARATUS WITH GARMENT END ROTATOR

BACKGROUND OF THE INVENTION

This invention relates generally to garment pressing apparatus and more particularly to pressing apparatus which is especially useful for pressing or topping the top waist area of a pair of pants as an operator turns the waist area around a buck and turning the already pressed cuffs and legs of the pants as the waist area is being topped.

The final operation in manufacturing a pair of pants is pressing the pants and this has been conventionally accomplished by first pressing the legs and cuff area of the pants followed by the separate operation of topping the waist area of the pants. During the topping step an operator turns the open waist area around the buck of the press and cycles a pressing head up and down with respect to the buck to top the pants. As the waist area is turned, the legs and cuffs of the pants are normally left hanging from the buck and these often become twisted and wrinkled as the operator tops the pants. Consequently the finished pair of pants which is intended for sale to the retail market very often contains undesirable wrinkles and the pants are not very appealing to the buying customer. This is particularly true with respect to new fabrics which are being advertised as "wrinkle free" or "wrinkle resistant". It is desirable that this problem be alleviated to enhance the appearance and value of the finished pants to a purchasing consumer.

SUMMARY OF THE INVENTION

The primary object of this invention is to provide novel garment pressing apparatus which may be used with various types of garments, but which is particularly useful for pressing a pair of pants and alleviating wrinkles produced by prior conventional apparatus.

A further object of the invention is to provide novel pressing apparatus including a rotator mechanism which grasps the bottom or cuff end of the pants and turns the legs of the pants as an operator turns the top waist end of the pants around a buck while at the same time cycling a presser head to top the pants. Rotating the cuffs and legs of the pants along with the waist end of the pants during the press operation advantageously avoids the formation of wrinkles in the legs of the pants.

Still another object of the invention is to provide the above novel pressing apparatus wherein the rotator mechanism is adjustable vertically and horizontally with respect to the buck to accommodate pants of various lengths.

Still another object of the invention is to provide the above novel pressing apparatus wherein a cuff clamping assembly which is part of the rotator mechanism may be turned at selected angular increments under the control of a microprocessor through 360° rotation. The number of increments is correlated to the number of hits or program runs for the press head selected by an operator to complete the topping operation on the waist area of the pants.

Other objects and advantages of the invention will become apparent from reading the following detailed description of the invention wherein reference is made to the accompanying drawings.

DETAILED DESCRIPTION OF THE INVENTION

Figure 1:
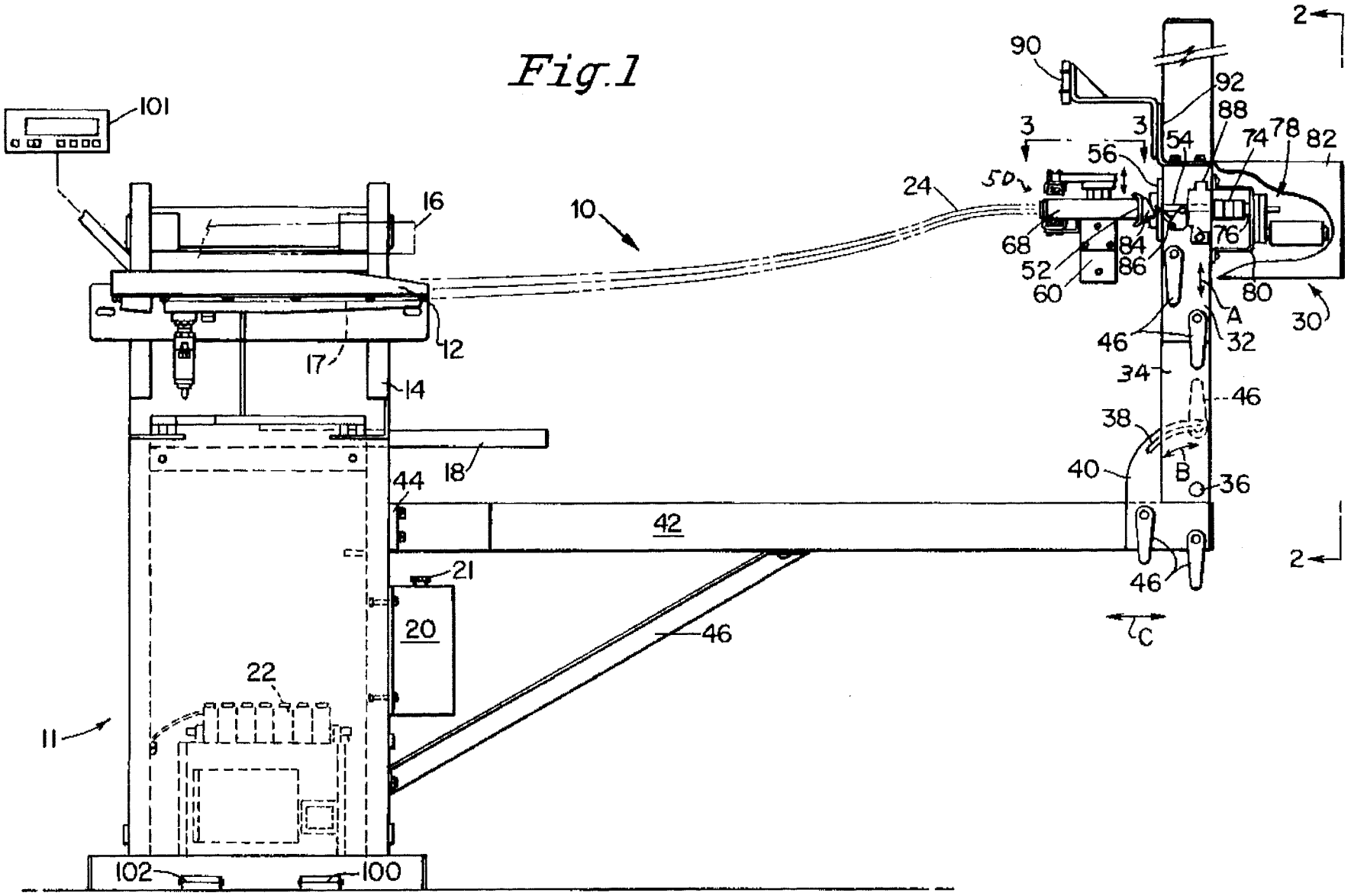
FIG. 1 is a front elevation view of a pressing machine incorporating the garment rotator mechanism of the invention.

Referring now to the drawings the invention may be used with various type garments, but will be described for pressing a pair of pants 10. The apparatus of the invention includes a conventional garment pressing machine 11 having a buck 12 mounted on a frame 14 in a fixed substantially horizontal position. A presser head 16 is mounted on frame 14 in conventional fashion for vertical reciprocating motion with respect to buck 12 so that the head is intermittently cycled into pressing engagement with a garment, for example the waist area 17 of pants 10 as the waist area is turned around the buck by an operator.

The press 11 is conventional and may for example include the usual work table 18 and electrical and pneumatic control box assemblies 20 and 22 for operating the press and supplying steam to the head and buck.

As mentioned above when pressing a pair of pants the legs and cuffs are pressed first and then the waist area 17 is pressed by placing the waist area over buck 12 and turning it around the buck as head 16 is cycled until the entire waist area is pressed. In the past the legs 24 and cuffs 26 of the pants have been permitted to simply hang loose from buck 12 and as the waist area was turned on the buck the legs became tangled and wrinkled and the finished pants did not have an acceptable pleasing appearance.

To overcome this problem the apparatus of the invention includes a pants rotator mechanism 30 which is adapted to grasp and hold the bottom or cuffs 26 of the pants legs 24 to rotate the legs as the operator turns the waist area 17 of the pants on buck 12 during the waist pressing operation. Rotator mechanism 30 includes a slide block 32 which is vertically adjustably mounted as indicated by arrow A on a vertical slide rail 34 that is pivotally connected by pivot pin 36 to bracket 40 and angularly adjustable with respect to bracket 40 via slot 38 as indicated by arrow B. In turn bracket 40 is adjustable horizontally as indicated by arrow C along a horizontal beam 42 connected at its inner end to a bracket 44 which is fixed to frame 14 of press 11.

As a result of this mounting, rotator mechanism 30 may be adjusted with respect to buck 12 vertically by moving slide block 32 up or down on rail 34, horizontally by moving bracket 40 horizontally along support rail 42, and angularly by pivoting rail 34 on bracket 40. Once adjusted the various elements are locked in place by tightening T-bolts 46. As a result rotator mechanism 30 can be positioned selectively to accommodate pants of various sizes and lengths.

Mechanism 30 includes a cuff clamp assembly 50 having a transverse arm 52 fixed at its center to shaft 54 supported within a bearing 56 which is mounted on the inside face of slide block 32. A pair of laterally spaced pneumatically operated clamps 57, 58 are operated by air cylinders 60 and 62 which are mounted on support plates 64 and 66 fixed to arm 52. A pair of end plates 68 and 70 extend longitudinally inwardly from arm 52 and act as pinching guide arms as the cuffs 26 and hanger 72 are placed into the clamp assembly.

Shaft 54 extends through a hole in slide block 32 and is fastened into a drive coupling 74 which is mounted on the output shaft 76 of a small gear motor drive assembly 78 that is supported by a bracket 80 from the outside face of slide block 32. A cover 82 encases the gear motor unit on the back of block 32.

When at rest the clamp mechanism 50 is maintained in a horizontal position essentially parallel to the horizontal position of buck 12 and that is accomplished by coaction between a cam element 84 fixed on the outer face of arm 52 and a roller lever arm 86 of microswitch 88 fixed on the side of slide block 32. When the rotating arm 52 and clamp mechanism 50 is returned to its horizontal home position, cam element 84 engages against roller lever 86 to open switch 88 and stop rotation of gear motor 78 and clamp mechanism 50.

In addition a photoelectric sensor 90 is mounted above clamp assembly 50 via bracket 92 fastened on top of slide block 32 and is adjustable angularly via slot 94 in bracket 92. The photocell 90 senses the presence or absence of cuffs 26 and hanger 72 within the clamping region of the clamp assembly. If no cuffs or hanger are within that area, air cylinders 60 and 62 can not be operated to close the clamps and mechanism 50 can not be rotated.

Figure 3:
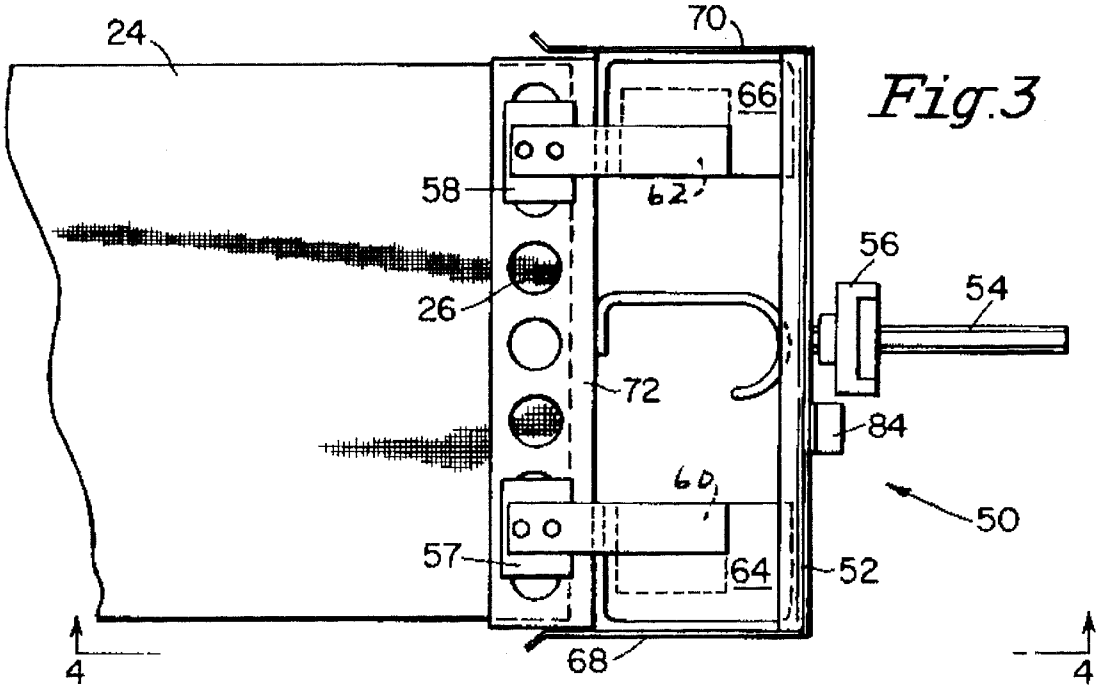
FIG. 3 is a fragmentary plan view of the clamp mechanism taken along line 3—3 of FIG. 1.
Figure 4:
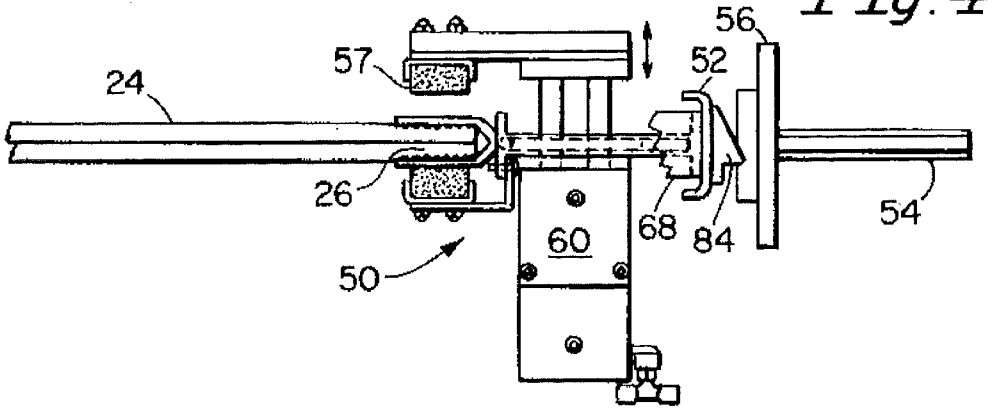
FIG. 4 is a fragmentary view of the clamp mechanism taken along line 4—4 of FIG. 3.
Figure 2:
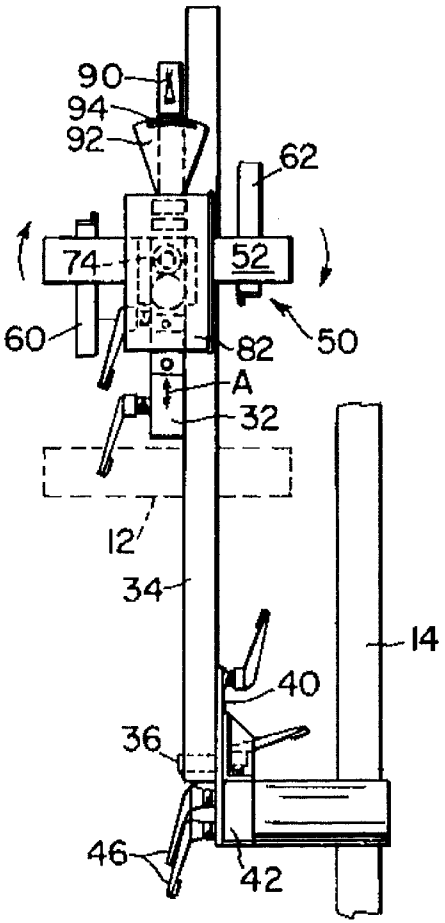
FIG. 2 is an end elevational view taken along line 2—2 of FIG. 1.
Figure 5:
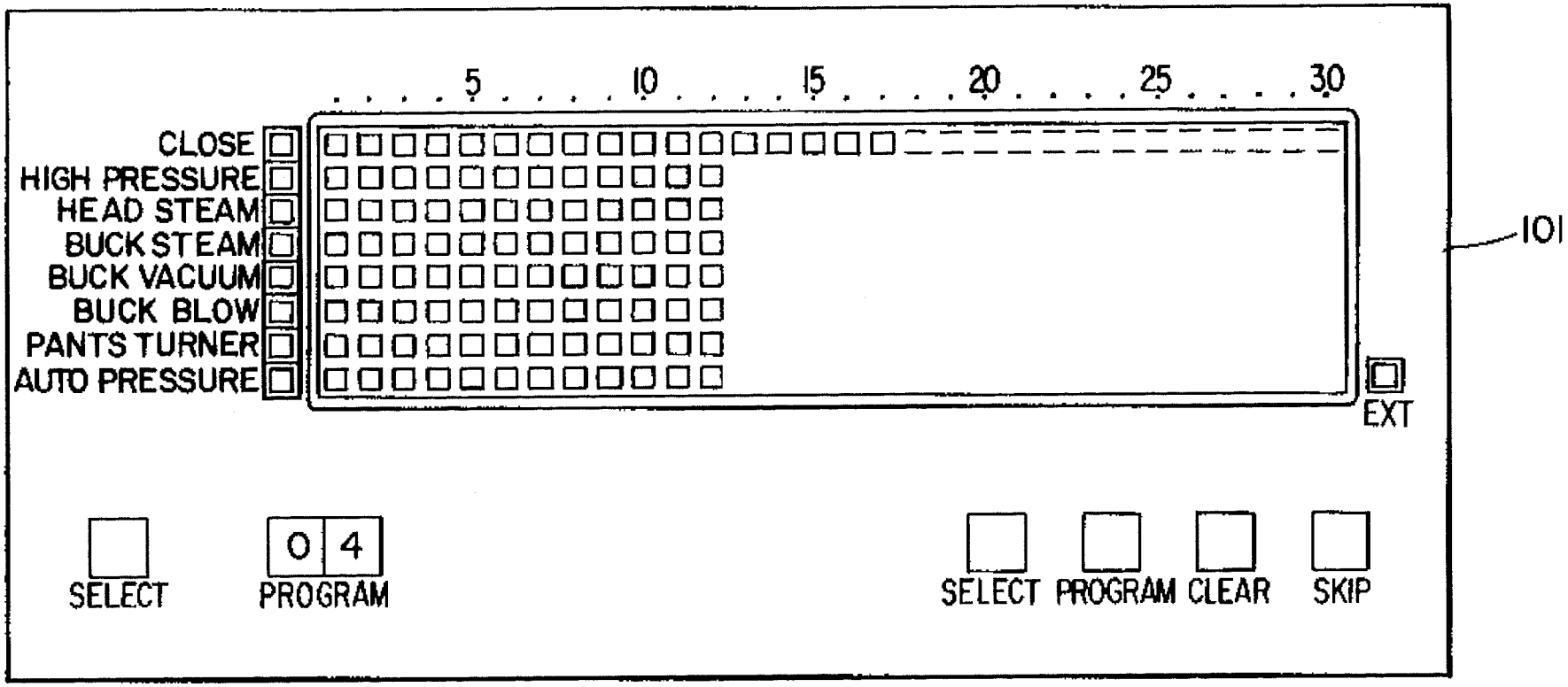
FIG. 5 is a schematic view of the front panel of a microprocessor unit by which the press and rotator mechanism are operated.

When pressing a pair of pants the legs 24 are first pressed and the bottoms or cuffs 26 are then pinched within hanger 72. In order to press the waist area 17 of the pants around buck 12, hanger 72 is placed within clamp assembly 50 as shown in FIGS. 3 and 4. Air cylinders 60 and 62 are then automatically operated in response to photoswitch 90 to close clamps 57 and 58 into pinching engagement with hanger 72. If the position of the hanger is not correct, an operator may trip a first foot switch 100 marked "rotator clamps" which opens the clamps. The operator may then reposition the hanger 72. As long as foot switch 100 is being held the clamps 57 and 58 will remain open. When the foot switch 100 is released again with the hanger 72 properly in place the clamps will automatically close.

After clamping the hanger 72 the operator then simply positions the open waist area 17 of the pants around buck 12 and then runs the press in normal fashion to cycle the head 16 up and down. As the operator turns the waist of the pants around buck 12 and cycles head 16, gear motor 78 is periodically energized and de-energized to turn clamp assembly 50 incrementally through 360° under the control of a microprocessor 101 mounted on frame 14. The microprocessor is programmed to incrementally turn clamp assembly 50 and the cuff of the pants in correlation with the number of times the operator turns the waist area on buck 12 and the number of cycles or hits through which the operator moves head 16. For example, the waist topping or pressing operation may take between 6 and 10 "hits" to fully press the waist area. The amount of time programmed on the microprocessor display channel labeled "pants turner" determines how long the pants rotator mechanism rotates with each hit. For example if one-half second rotation time per program run or hit is used, then every time the press runs the rotator rotates for one-half second. On average if programmed one second it takes about 8 to 9 program runs to rotate 360°. If the operator programs one and one-half seconds into the microprocessor it will take 4 to 5 program runs or hits to rotate a complete 360°. The speed of rotation during each run period may be controlled by a speed rotation knob 21 located on top of the electrical box 20.

As the operator continues to turn the waist of the pants around the buck and cycles head 16, microprocessor 100 automatically turns clamp assembly 50. When the clamp assembly has completed 360° rotation and returns to the home position, cam 84 actuates roller lever 86 to open switch 88 to stop rotation of the clamp assembly. The operator then hits foot peddle 100 to open clamps 56 and 58 to permit removal of the pressed pants and insertion of the next pair of pants.

If for some reason the operator unloads a hanger 72 from clamp assembly 50 before the assembly rotates through a full 360°, the microprocessor automatically returns the clamp assembly to its home position ready for loading of the next hanger. A second foot switch 102 marked "prevent rotate" will not allow rotation of assembly 50 through the following program runs until foot switch 102 is hit again.

It is thus apparent that the rotator mechanism 30 conveniently incrementally turns the already pressed cuffs and legs of the pants 10 while the operator is pressing and turning the waist area 17 of the pants around buck 12. When the finished pants are removed from the press, the legs of the pants remain neatly pressed and contain no wrinkles.

Because the rotator mechanism is adjustable vertically and horizontally with respect to buck 12, the press is quickly adjustable to accommodate pants of different lengths. Similarly to accommodate pants of various size waists which may require more or fewer turns of the waist around buck 12 and cycles of head 16, the number of angular increments through which clamp assembly 50 is advanced before rotating through a complete 360° may be correspondingly varied by microprocessor 100.

Although the invention has been described as it applies to pressing a pair of pants, it is to be understood that it may be used with any type of garment which would benefit from holding and turning one end of the garment which is already pressed while the opposite end is being pressed. Thus the invention is obviously applicable to pressing other garments such as skirts, shorts, shirts, etc. which fall into this category.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Apparatus for pressing a clothes garment having first and second opposite ends comprising a buck around which the first end of the garment is turned as it is pressed, a rotator mechanism comprising clamp means for clamping the second end of the garment and drive means for rotating said clamp means and second end of the garment as said first end of the garment is turned on the buck.

2. Apparatus as defined in claim 1, comprising a presser head mounted adjacent said buck and movable toward and away from said buck to press the first end of the garment as the first end is turned around the buck, and control means for energizing said drive means to rotate said clamp means incrementally as said presser head is intermittently operated to press the first end of the garment as the first end is incrementally turned around the buck.

3. Apparatus as defined in claim 2, wherein said control means incrementally advances said clamp means in correlation with the intermittent operation of said presser head.

4. Apparatus as defined in claim 2, wherein said buck lies in a substantially horizontal plane and said clamp means rotates about a generally horizontal axis.

5. Apparatus as defined in claim 4, said rotator mechanism comprising first sensor means for positioning said clamp means in a substantially horizontal plane for receipt of a new garment therein.

6. Apparatus as defined in claim 5, said rotator mechanism comprising second sensor means for sensing the presence of a garment in said clamp means.

7. Apparatus as defined in claim 4, said rotator mechanism comprising second sensor means for sensing the presence of a garment in said clamp means.

8. Apparatus as defined in claim 4, said rotator mechanism being adjustable horizontally with respect to said buck to accommodate garments of various sizes.

9. Apparatus as defined in claim 8, said rotator mechanism also being adjustable vertically with respect to said buck.

10. Apparatus as defined in claim 4, said rotator mechanism being adjustable vertically with respect to said buck.

11. Apparatus as defined in claim 1, wherein said garment is a pair of pants, said first end being the waist area of said pants and said second end being the bottom of the legs of the pants.

12. Apparatus for pressing a clothes garment having first and second opposite ends comprising a stationary buck around which the first end of the garment is turned as it is pressed, a presser head mounted adjacent said buck and movable toward and away from said buck to press the first end of the garment as the first end is turned around the buck, and a rotator mechanism for holding the second end of the garment and rotating the second end of the garment with the first end of the garment as the first end is turned on the buck.

13. Apparatus as defined in claim 12, said rotator mechanism comprising clamp means for clamping the second end of the garment and drive means for rotating said clamp means and second end of the garment as said first end of the garment is turned on the buck.

14. Apparatus as defined in claim 13, comprising control means for energizing said drive means to rotate said clamp means incrementally as said presser head is intermittently operated to press the first end of the garment as the first end is incrementally turned around the buck.

15. Apparatus as defined in claim 14, wherein said control means incrementally advances said clamp means in correlation with the intermittent operation of said presser head.

16. Apparatus as defined in claim 12, wherein said buck lies in a substantially horizontal plane and said clamp means rotates about a generally horizontal axis.

17. Apparatus as defined in claim 16, said rotator mechanism being adjustable horizontally with respect to said buck to accommodate garments of various sizes.

18. Apparatus as defined in claim 17, said rotator mechanism also being adjustable vertically with respect to said buck.

19. Apparatus as defined in claim 16, said rotator mechanism being adjustable vertically with respect to said buck.

* * * * *